US006089334A

United States Patent [19]

Watts

[11] Patent Number: 6,089,334

[45] Date of Patent: Jul. 18, 2000

[54] INVERTIBLE AUGER

[75] Inventor: Verne C. Watts, Lisbon, N. Dak.

[73] Assignee: Clark Equipment Company, Woodcliff Lake, N.J.

[21] Appl. No.: 09/042,285

[22] Filed: Mar. 13, 1998

[51] Int. Cl.[7] ..... E21B 10/44

[52] U.S. Cl. ..... 175/170; 175/323; 175/394

[58] Field of Search ..... 175/397, 170, 175/392, 394, 320, 323

[56] References Cited

U.S. PATENT DOCUMENTS

| | | | |
|---|---|---|---|
| 1,848,762 | 3/1932 | Atkinson . | |
| 2,221,680 | 11/1940 | Parrish | 255/69 |
| 2,320,612 | 6/1943 | Kandle | 255/69 |
| 2,821,364 | 1/1958 | Godfrey | 255/64 |
| 3,072,205 | 1/1963 | Govin | 175/386 |
| 3,174,801 | 3/1965 | Owen et al. | 175/323 X |
| 3,178,210 | 4/1965 | Dickinson | 175/323 X |
| 3,995,706 | 12/1976 | White | 175/392 |
| 4,699,226 | 10/1987 | Müller et al. | 175/323 |
| 5,556,217 | 9/1996 | Deyo et al. | 403/61 |

*Primary Examiner*—Roger Schoeppel
*Attorney, Agent, or Firm*—Westman, Champlin & Kelly, P.A.

[57] ABSTRACT

An earth auger has a center shaft and a helical flighting extending along the axis of the shaft. The flighting and the center shaft have opposite ends that are identical in construction, so that the auger can be driven from either end by a power unit.

7 Claims, 2 Drawing Sheets

INVERTIBLE AUGER

BACKGROUND OF THE INVENTION

The present invention relates to a power earth auger, which can be driven from either end. If one end becomes worn or damaged the auger can be inverted, and inverting a pilot bit that is normally used with an auger charged from one end of the auger tube to the other to extend the useful life of the auger.

Powered earth augers mounted on a skid steer loader, a backhoe boom or an excavator boom are used quite widely. The augers are generally driven by a power unit that will couple to a number of different auger sizes and lengths. Reversible hydraulic motors are used conventionally for powering the auger. This permits the auger to be driven in either direction of rotation. Different horse power hydraulic motors can be utilized for different sized augers as needed.

SUMMARY OF THE INVENTION

The present invention provides a powered earth auger that has a central tube or shaft with either single or double helix flight, used for boring holes in the ground. The center tube has identically constructed opposite ends to permit the auger to be driven from either end, and conversely permit either end to be used as the earth penetrating end.

The central tube or shaft has a drive connection at either end. The end of the helix that engages the ground is provided with a shank plate, that is, a reinforcing bar at the leading end of the helical flight used to support teeth that will rip into the ground as the auger rotates, to aid in penetration.

Additionally, the augers normally include a pilot bit at the end that enters the ground. The pilot bit mounts on the center shaft and extends out axially farther than the auger helical flights, and holds the auger at an entry location as the auger flights first engage the ground.

The auger shaft is adapted to have a drive connection for the auger bit and the power unit drive shaft at each end.

The helical flights also are provided with a shank plate at each end. The end that is coupled to the power unit has removable teeth removed from the shank plate. The teeth for the shank plate will be added when the auger has been inverted and the pilot bit inserted at the end to be used for boring.

The ability to use both ends for boring extends the life of the augers because the end that enters the ground is subject to greater wear, and also can be damaged more frequently by rocks or obstructions that it might strike.

DETAILED DESCRIPTION OF THE PREFERRED EMBODIMENTS

Figure 1:
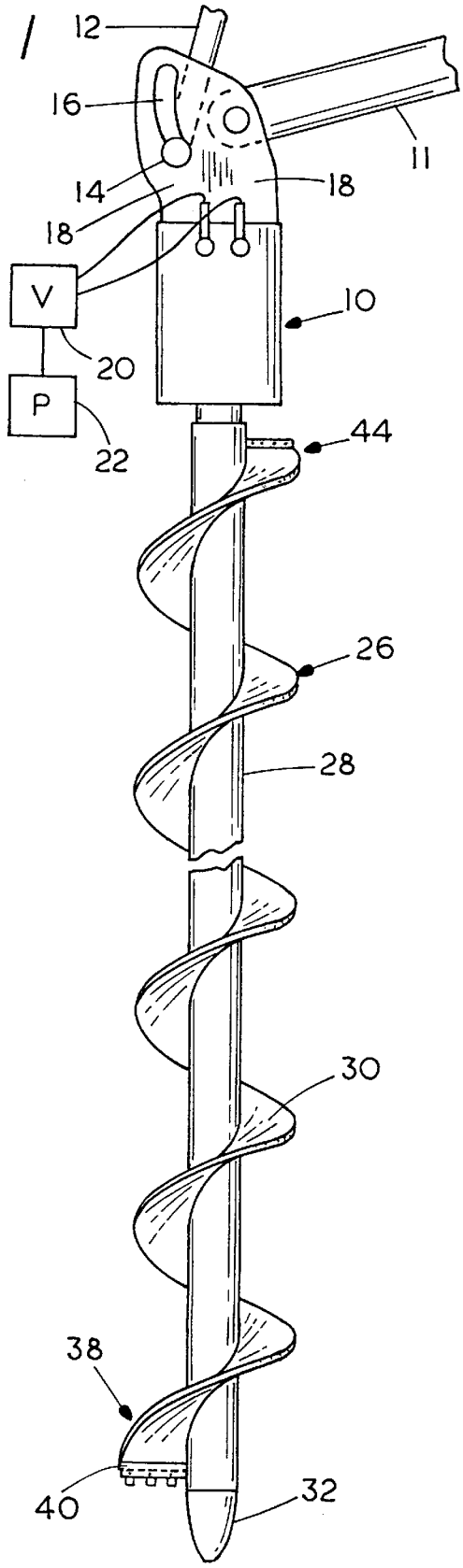
FIG. 1 is a side elevational view of an earth auger made according to the present invention.

In FIG. 1 a hydraulic motor drive unit indicated generally at 10 is mounted onto a suitable boom or arm 11 of a backhoe or excavator. A link 12 is used for controlling the pivoting of the power unit 10 through a pin 14 that slides in a slot 16. The link 12 is of the type shown in U.S. Pat. No. 5,556,217, and the mounting bracket 18 can be the same as that shown in U.S. Pat. No. '217.

The hydraulic motor 10 is connected in a hydraulic circuit including an operator controlled valve 20 and that receives hydraulic fluid from a pump 22 in a conventional manner. The pump and valve are positioned to be accessible to an operator of the excavator, backhoe or other machine that is being utilized.

Figure 4:
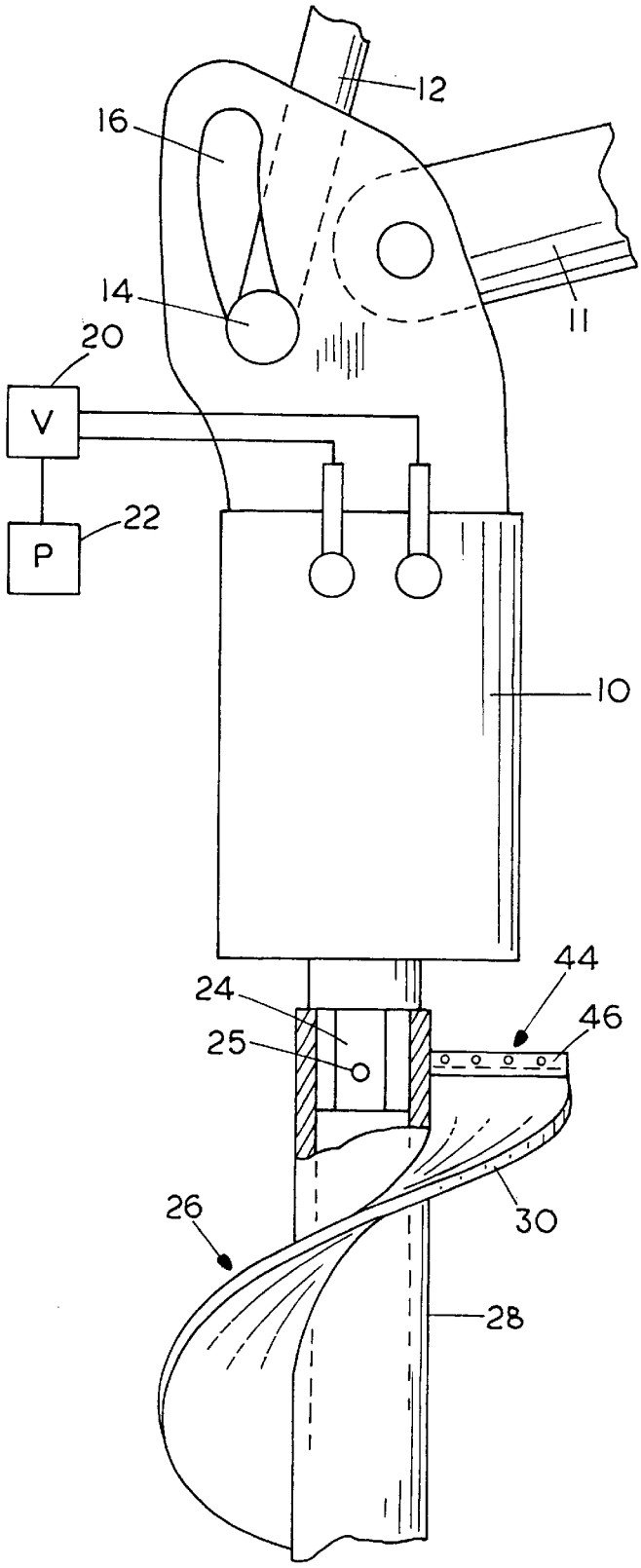
FIG. 4 is an enlarged view of the drive end of the auger of FIG. 1, with parts in section and parts broken away.
Figure 5:
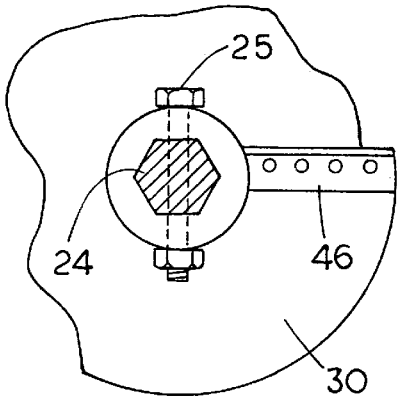
FIG 5 is a sectional view taken along 5—5 in FIG. 4.

The hydraulic motor has an output drive shaft 24 (See FIG. 4), which in this form of the invention has a hexagon cross section as shown in FIG. 5. The drive shaft 24 is made to drive an earth boring auger shown generally at 26, which includes a center tubular shaft 28 and a helical flighting 30 fixed to the center tube. In this instance, the flighting 30 is single helix, but many earth augers will use a double helix for added capacity.

The helix 30 forms an auger flight that is welded to the tubular shaft 28, and when the power unit 10 is powered, tubular shaft 28 will be rotated and will bore into the earth in a known manner. The auger flight has a rotationally leading edge at the lower end of the auger.

Figure 2:
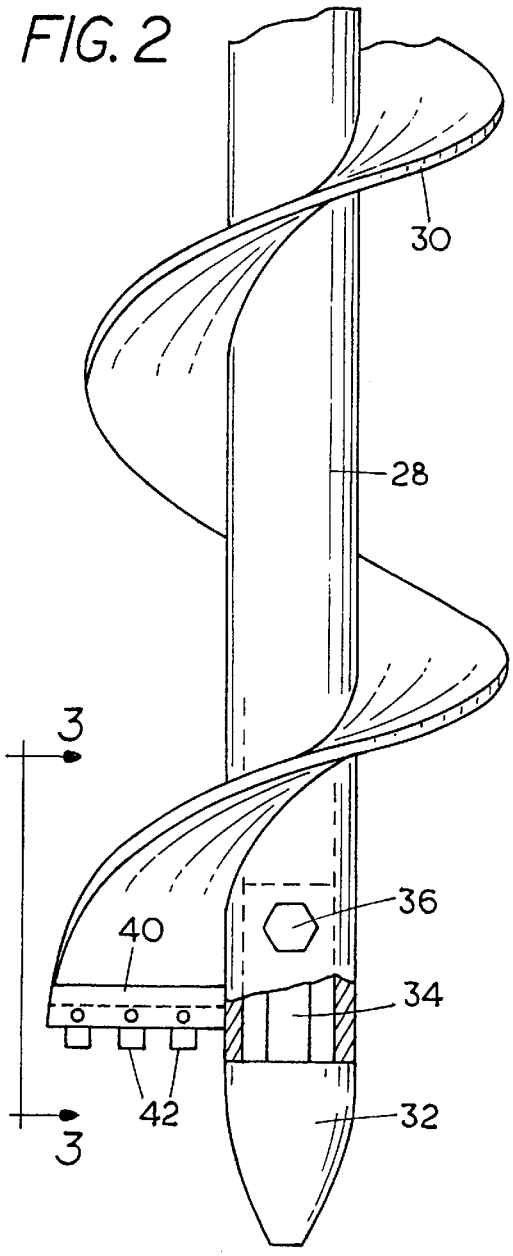
FIG. 2 is an enlarged side view of the auger of FIG. 1 showing the lower end of the auger.
Figure 3:
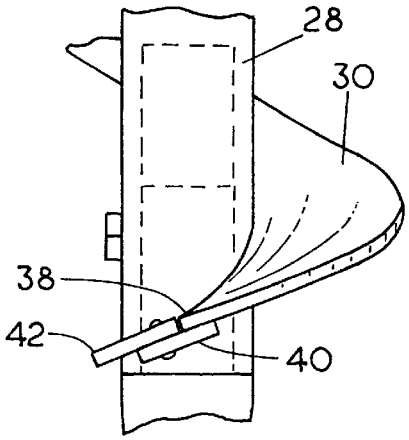
FIG. 3 is a view taken on line 3—3 in FIG. 2.

In FIG. 2, the lower end of the auger is illustrated, and it includes a pilot bit 32 that also has a shaft section 34 which fits into the hexagon cross-section bore of the tubular auger shaft 28 and can be pinned in place with a suitable bolt 36. The drive shaft 24 of the power unit also is pinned in place with a suitable bolt 25. The location of the bolt hole measured from the end of the auger tubular shaft is the same at both ends of the auger. The leading edge 38 of the ground engaging end of the auger flight shown in FIG. 3, is provided with a shank plate or reinforcing bar 40. The shank plate 40 is placed in relation to the leading edge of the auger flight so that the shank plate will tilt downwardly slightly. A plurality of digging teeth 42 are removably mounted (bolted) in place onto the shank plate 40. The upper end of the auger flight shown in FIG. 4 at 44 is provided with a shank plate 46 which is identical to the shank plate 40, and is mounted in the same manner so that when the auger is inverted end for end the upper shank plate 46 is oriented to engage the ground. While the removable teeth 42 are not illustrated at the upper end of the auger, they can be bolted to the shank plate 46 in the same manner as shown in FIG. 3.

The opposite ends 44 and 38 of the auger are identically constructed, and both include a socket or drive portion for receiving either the power shaft 24 or the shaft 34 for the pilot bit 32. The pins 25 and 36 are positioned at the same location relative to the end surface of the auger and are made so that they will pass through provided openings in either the drive shaft 24 or the shaft 34 for the pilot bit 32. The auger can be turned end for end and driven from either of the two ends, with the other end, opposite from the power unit or drive unit, receiving the pilot bit 32 and being the first end that will bore into the ground when the unit is used.

The useful life of an auger is extended because if damage occurs to the end that engages the ground, as sometimes happens, the auger can be inverted, the pilot bit removed from the previously used end and the drive shaft 24 inserted for driving the auger. The removable teeth can be placed onto the shank plate from the previously driven end and the unit is ready to run when the pivot bit is also reinserted.

Although the present invention has been described with reference to preferred embodiments, workers skilled in the art will recognize that changes may be made in form and detail without departing from the spirit and scope of the invention.

What is claimed is:

1. A powered earth auger for boring into the ground, said auger comprising a central mounting shaft, a helical auger flight attached to said mounting shaft and extending along an axial length thereof, said helical auger flight having digging edges at opposite ends thereof, which extend on a line generally radial from the auger shaft, and said auger shaft having a substantially identical drive section at each end capable of receiving a drive shaft for a power unit to permit selectively driving the auger from either end.

2. The auger of claim 1 including a ground engaging reinforcing plate along each of the auger flight edges at the opposite ends of the auger flight.

3. The auger of claim 1 and a pilot bit having a shaft portion substantially identically in size and shape to the drive shaft of the power drive, and being adapted to be secured in the drive portions of the auger shaft.

4. The auger of claim 3, wherein said drive portions comprise a hexagon cross section bore portion.

5. A powered earth auger for boring into the ground, said auger comprising a central mounting shaft having tubular portions at each end, a helical auger flight attached to said mounting shaft and extending along an axial length thereof, said helical auger flight having edges that extend generally radially from the shaft at the opposite ends of the shaft, and said tubular ends of the auger shaft each having a substantially identical internal drive cross section to drivably receive a shaft for drivably coupling thereto, the edges of the helical auger flight at both ends engaging and boring into the ground when an opposite end of the auger shaft is driven.

6. The auger of claim 5 including a ground engaging reinforcing plate along each of the auger flight edges at the opposite ends of the auger.

7. The auger of claim 5 and a pilot bit having a shaft portion to drivably fit into the tubular end portions of the auger shaft.

* * * * *